US005171295A

United States Patent [19]

Schwalm, Jr.

[11] Patent Number: 5,171,295

[45] Date of Patent: Dec. 15, 1992

[54] PORTABLE PULLEY EXERCISER BODY FITNESS APPARATUS

[76] Inventor: Felipe A. Schwalm, Jr., 12000 NE. 16th Ave., Lot L-1013, No. Miami, Fla. 33161

[21] Appl. No.: 710,753

[22] Filed: May 31, 1991

[51] Int. Cl.[5] ..... A63B 21/00

[52] U.S. Cl. ..... 482/131; 482/148; 482/904

[58] Field of Search ..... 272/136, 126, 134, 900, 272/144, 142, 138; 128/25 R; 482/129, 131, 134, 135, 138, 139, 133, 142, 143, 144, 123

[56] References Cited

U.S. PATENT DOCUMENTS

| | | | |
|---|---|---|---|
| 885,243 | 4/1908 | Hass | 272/144 |
| 1,612,496 | 12/1926 | Dobbins | 272/126 |
| 1,623,672 | 4/1927 | Frankenfeld | 272/138 |
| 4,136,868 | 1/1979 | Hogue | 272/144 |
| 4,205,839 | 6/1980 | Best | 272/126 |
| 4,257,592 | 3/1981 | Jones | 272/126 |
| 4,265,447 | 5/1981 | Shafer | 272/900 |
| 4,634,119 | 1/1987 | Pesthy | 272/142 |

*Primary Examiner*—Richard J. Apley
*Assistant Examiner*—Jerome Donnelly
*Attorney, Agent, or Firm*—Richard L. Miller

[57] ABSTRACT

A portable pulley exerciser body fitness apparatus is provided and consists of an elongated bar, a pair of pulleys, each affixed to one end of the elongated bar, a cord extending about the pulleys and a pair of handles, each removably affixed to one end of the cord so that a person can grip the handles to do exercises.

3 Claims, 2 Drawing Sheets

PORTABLE PULLEY EXERCISER BODY FITNESS APPARATUS

BACKGROUND OF THE INVENTION

The instant invention relates generally to physical exercisers and more specifically it relates to a portable pulley exerciser body fitness apparatus Numerous physical exercisers have been provided in the prior art that are adapted to develop and condition all of the important muscles For example, U.S. Pat. Nos. Des. 256,821 to Weider; Des. 277,497 to Johnson and 4,775,146 to Stankovic all are illustrative of such prior art. While these units may be suitable for the particular purpose to which they address, they would not be as suitable for the purpose of the present invention as hereafter described.

SUMMARY OF THE INVENTION

A primary object of the present invention is to provide a portable pulley exerciser body fitness apparatus that will overcome the shortcomings of the prior art devices.

Another object is to provide a portable pulley exerciser body fitness apparatus in which a great number of exercises can be performed utilizing the various components of the apparatus.

An additional object is to provide a portable pulley exerciser body fitness apparatus that is lightweight and can be folded up to be stored behind a door or a chair.

A further object is to provide a portable pulley exerciser body fitness apparatus that is simple and easy to use.

A still further object is to provide a portable pulley exerciser body fitness apparatus that is economical in cost to manufacture.

Further objects of the invention will appear as the description proceeds.

To the accomplishment of the above and related objects, this invention may be embodied in the form illustrate in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
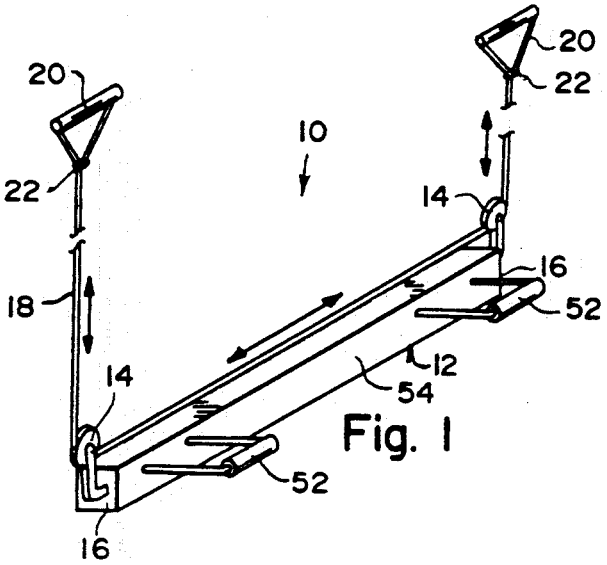
FIG. 1 is a perspective view of the instant invention.
Figure 6:
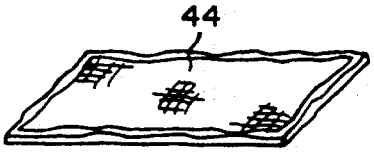
FIG. 6 is a perspective view of a rest mat used with the instant invention per se.
Figure 2:
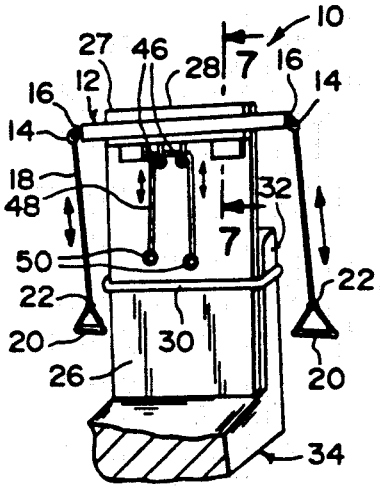
FIG. 2 is a perspective view of the instant invention shown installed on a panel secured against a backrest of a chair.
Figure 3:
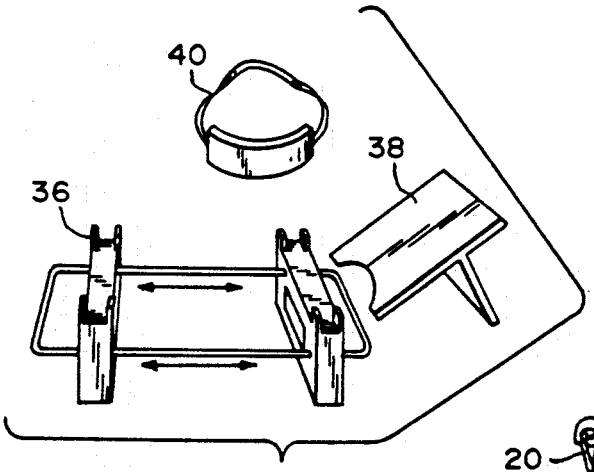
FIG. 3 is a perspective view shown with a platform, recliner and head strap used for various exercises.
Figure 4:
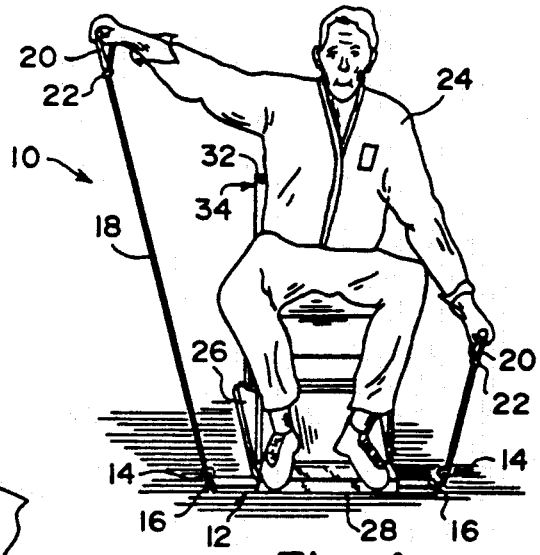
FIG. 4 is a perspective view illustrating a person using the invention while sitting on a chair over the device.
Figure 5:
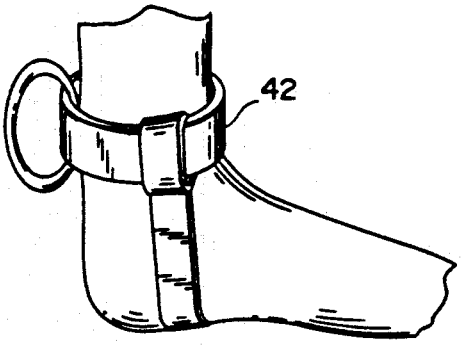
FIG. 5 is a side perspective view illustrating a typical foot harness.
Figure 7:
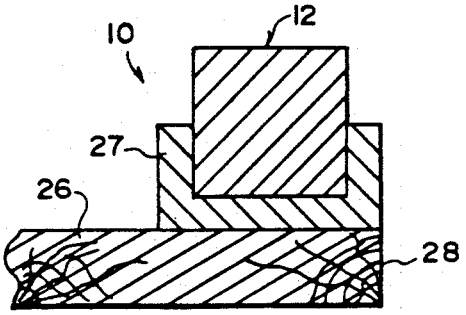
FIG. 7 is a cross sectional view taken along line 7—7 in FIG. 2 showing the retainer channel in greater detail.

Turning now descriptively to the drawings, in which like reference characters denote like elements throughout the several views, the Figures illustrate a portable pulley exerciser body fitness apparatus 10 consisting of an elongated bar 12 and a pair of pulleys 14. Each pulley 14 is affixed to one end 16 of the elongated bar 12. A cord 18 extends about the pulley 14, while a pair of handles 20 are provided. Each handle 20 is removably affixed to one end 22 of the cord 18 so that a person 24 can grip the handles 20 to do exercises.

The portable pulley exerciser body fitness apparatus 10 further includes a rectangular shaped panel 26 having a retainer channel 27 proximate to one end 28 thereof in which the elongated bar 12 can be inserted into the retainer channel 17 so that additional exercises can be performed. A belt 30 is to secure the panel 20 to the front of a backrest 32 of a chair 34 so that a triceps curl exercise can be performed.

Figure 9:
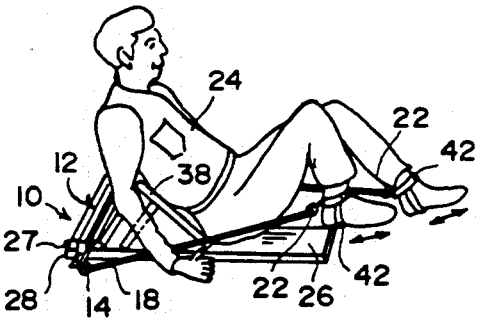
FIG. 9 is a perspective view illustrating the person utilizing the recliner shown in FIG. 3.
Figure 10:
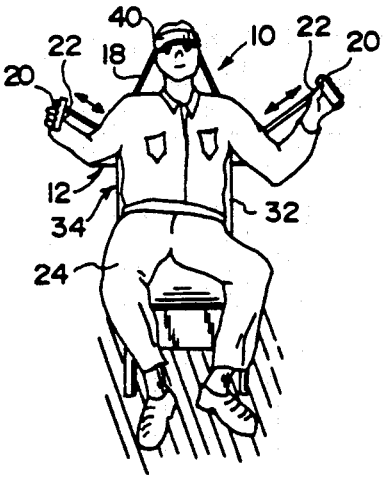
FIG. 10 is a perspective view illustrating the person utilizing the head strap shown in FIG. 3.

The portable pulley exerciser body fitness apparatus 10 further includes an adjustable platform 36 to elevate the chair 34 for doing a front of the thigh curl exercise. A recliner 38 is to support a back of the person for doing a leg press exercise as shown in FIG. 9. A head strap 40 is to engage the cord 18 between the pulleys 14 for doing a neck front curl exercise, as shown in FIG. 10.

The portable pulley exercise-body fitness apparatus 10 further includes a pair of foot harnesses 42, with each removably affixed to one end 22 of the cord 18 for doing the leg press exercise. An optional rest mat 44 may also be provided so that the person 24 may sit and lay on said rest mat 44 in comfort when doing the various exercises.

Figure 8:
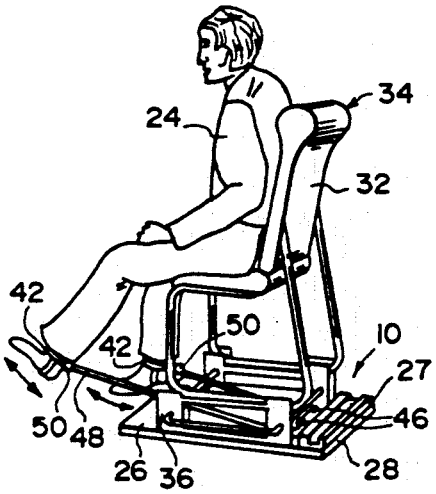
FIG. 8 is a perspective view illustrating the person utilizing the platform shown in FIG. 3 and the auxiliary cord and pulleys shown in FIG. 2.

The portable pulley exerciser body fitness apparatus 10 further includes a pair of auxiliary pulleys 46, each affixed in a side by side relationship to the inner edge of the retainer channel 27 on the panel 26. An auxiliary cord 48 extends about the pulleys 46, so that each of the foot harnesses 42 are removably affixed at 50 to one end of said auxiliary cord 48 when doing the front of the thigh curl exercises as shown in FIG. 8.

The portable pulley exerciser body fitness apparatus 10 further includes a pair of hand grips 52, each affixed to one side 54 and proximate one end 16 of the elongated bar 12 so that when the elongated bar 12 is inserted into the retainer channel 27 on the panel 26 and the panel 26 is placed upon the floor the person 24 can do push-up exercises therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable pulley exercise body fitness apparatus which comprises:

a) an elongated bar having a pulley member attached to each end and a cord means with removable handles on each end, extending about said pulleys;

b) a rectangular shaped panel, to be used as a base, having a retainer channel proximate to one end thereof in which said elongated bar can be inserted and secured, so as to expand the functionality of the device in performing various exercises;

c) a pair of elongated chair elevating and support members, for elevating a chair when doing a front of the thigh curl exercise further including: a chair leg locating channel on an upper side thereof for positioning at least one leg of a chair within and a means adjustable interconnecting said chair supporting members so as to allow said elongated chair supporting members to adjust towards and away from each other while maintaining a parallel orientation, thus allowing the supports to conform to a plurality of chairs having variable spaced leg members.

d) a reclining member to support a back of a person when performing a leg press exercise;

e) a head strap means configured to engage said cord between said pulleys when doing a neck front curl exercise; and f) a pair of foot harnesses, each configured to be removably affixed to respective ends of said cord when performing a leg press exercise.

2. A portable pulley exerciser body fitness apparatus as recited in claim 1, further including a belt to secure said panel to the front of a backrest of a chair so that a triceps curls exercise can be performed.

3. A portable pulley exerciser body fitness apparatus as recited in claim 1, further including a rest mat so that the person may sit and lay on said rest mat in comfort when doing the various exercises.

* * * * *